US010942000B2

(12) United States Patent
Preston

(10) Patent No.: US 10,942,000 B2
(45) Date of Patent: Mar. 9, 2021

(54) GUN STABILITY PLATE ASSEMBLY

(71) Applicant: David Preston, Greenville, PA (US)

(72) Inventor: David Preston, Greenville, PA (US)

( * ) Notice: Subject to any disclaimer, the term of this patent is extended or adjusted under 35 U.S.C. 154(b) by 0 days.

(21) Appl. No.: 16/682,400

(22) Filed: Nov. 13, 2019

(65) Prior Publication Data

US 2020/0348101 A1 Nov. 5, 2020

Related U.S. Application Data

(60) Provisional application No. 62/841,704, filed on May 1, 2019.

(51) Int. Cl.
*F41A 23/02* (2006.01)
*F41A 23/18* (2006.01)

(52) U.S. Cl.
CPC ..... *F41A 23/02* (2013.01); *F41A 23/18* (2013.01)

(58) Field of Classification Search
CPC ..... F41A 23/02; F41A 23/16; F41A 23/18; F41A 23/52; F41A 23/54; F41C 27/04; F16M 2200/021; F16M 2200/02
USPC ..... 42/94; 89/37.04
See application file for complete search history.

(56) References Cited

U.S. PATENT DOCUMENTS 6,029,386 A * 2/2000 Globig ..... F41A 23/18 211/64
9,568,265 B2 * 2/2017 Bastian, Jr. ..... F41A 23/02
2010/0301184 A1 * 12/2010 Stabler ..... F16M 13/00 248/346.5
2012/0144717 A1 * 6/2012 Peterson ..... F41G 11/003 42/94
2019/0219353 A1 * 7/2019 Cauley, Jr. ..... F41A 23/16
2020/0218139 A1 * 7/2020 Tiefenbrunn ..... G03B 17/561

* cited by examiner

*Primary Examiner* — Stephen Johnson
(74) *Attorney, Agent, or Firm* — Law Office of Jeff Williams PLLC; J. Oliver Williams

(57) ABSTRACT

A gun stability plate assembly includes a widened body that attaches to the fore-end of a stock or chassis of a gun by means of a clamping device. The assembly includes a main body, a clamp assembly, and a track. The clamp assembly is in communication with the main body and is configured to translate adjacent an upper surface of the main body. A rotating knob regulates operation of the clamp by rotating about an axis. The axis of the knob is coplanar with a central plane of the main body. The track is formed into the main body and configured to seat the clamp. The track is recessed into the main body. An accessory aperture is located within the main body and configured to permit attachment of one or more accessories.

18 Claims, 7 Drawing Sheets

GUN STABILITY PLATE ASSEMBLY

CLAIM OF PRIORITY

This application claims the benefit of U.S. Provisional Application No. 62/841,704, filed 1 May 2019. The information contained therein is hereby incorporated by reference.

BACKGROUND

1. Field of the Invention

The present application relates to a firearm accessory, and more particularly to a modular mounting gun plate for stabilizing a firearm for shooting.

2. Description of Related Art

Stability while shooting is one key to hitting a target consistently. Often, shooters using a handgun will brace the shooting hand with the opposing hand in order to stabilize the firearm. With rifles, shooters will often rest the firearm on an object. These objects can be anything from a mechanical tripod, a tree branch, the dirt, or a sandbag for example. Although these objects help stabilize the firearm, the objects fail to adequately prevent rotation of the rifle about its length. Even such small variations, such as rotation, can affect accuracy. Although strides have been made to provide improved stability while shooting, shortcomings remain.

SUMMARY OF THE INVENTION

It is an object of the present application to provide a gun stability plate to assist in stabilizing a gun when fired. This is primarily intended to be used with any type of gun or firearm but is ideally suited for rifles. The stability plate is configured to be releasably mounted to an underside of the gun and is designed to increase the width of the gun footprint such that when located on a surface, the gun can remain upright.

It is a further object of the present application that the gun stability plate have quick release attachment knobs to loosen corresponding clamps that attach to the gun. The clamps are configured to clasp the fore-end of the rifle stock or chassis. The gun stability plate is configured to attach to any Arca-styled rail with either one or more top side surface dovetail clamps. Such can be used in combination with shooting bags or without shooting bags for reduced wobble.

Another object of the present application is to provide accessory mounting locations for options items while it is mounted on the chassis or shock of the rifle. Such items may include a rangefinder or spotting scope for example. One or more clamps may be located on a lower surface to facilitate Arca-compatible connectivity (i.e. tripods)

The plate assembly includes a body that can have various shapes or be of various sizes. The particular contours and apertures throughout the plate can vary depending upon design considerations. Various Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
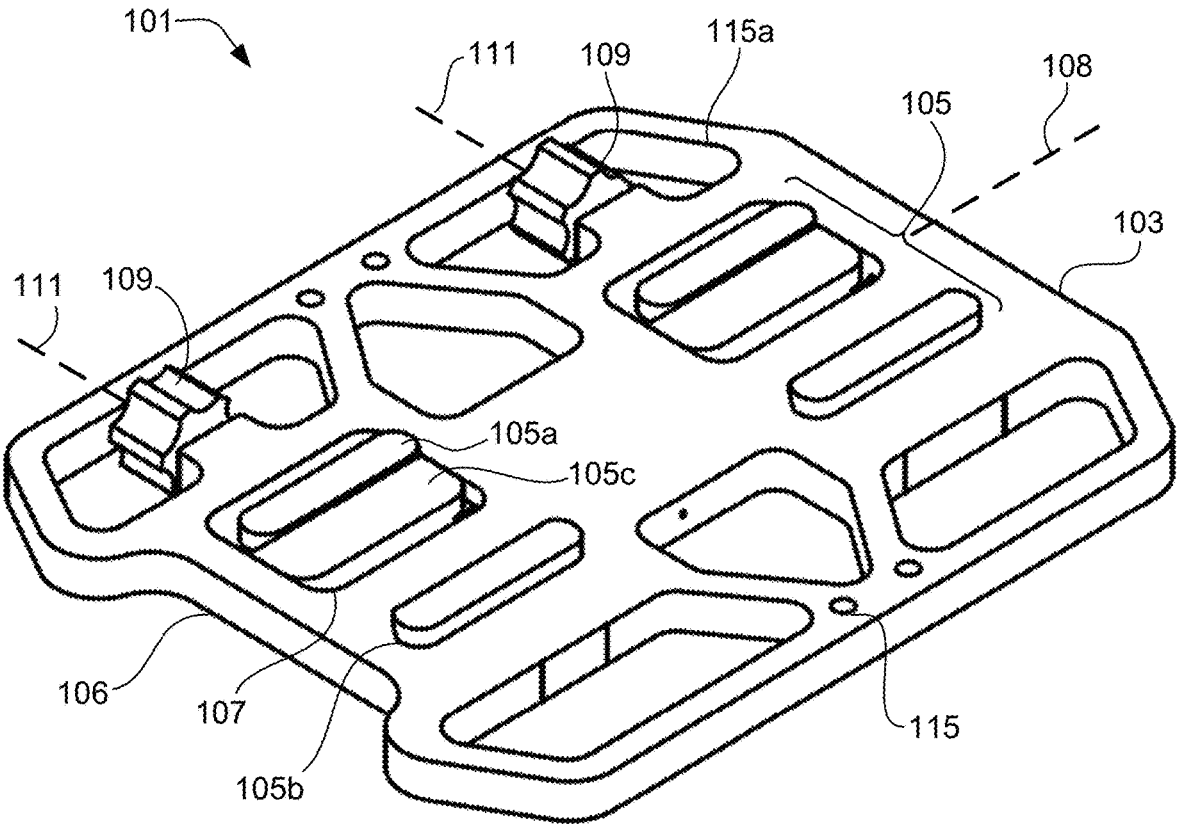
FIG. 1 is a perspective view of a gun plate assembly according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with the prior art discussed previously. In particular, the gun stability plate of the present application is configured to increase the stability of a gun so as to maintain it in an upright orientation when firing. The plate assembly is configured to also attach and detach quickly along a bottom surface of the gun. One or more locations may be suitable for attachment of other accessories. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The embodiments and method of the present application is illustrated in the associated drawings. The gun stability plate assembly includes a widened body that attaches to the fore end of a stock or chassis of a gun by means of a clamping device. The clamping device is machined to accept a standard picatinny rail or ARCA rail (i.e. 1.5" ARCA rail). The clamp is ideally machined into the body for a low profile. Additional features and functions are illustrated and discussed below.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Referring now to FIGS. 1-4 in the drawings, a assorted views of a gun stability plate assembly 101 are illustrated. Assembly 101 includes a main body 103, a clamp assembly 105, and a track 107. The main body 103 is formed to any shape but is preferably contoured to have a relatively planar form with an upper surface 103*a* and a lower surface 103*b*. The height is minimal between surfaces 105*a* and 105*b* as compared to the width and length of body 103. This low height and wide shape act to increase the stability of assembly 101 when coupled to a gun. The perimeter of body 103 may also take many shapes and is not herein limited to that shown in the drawings. A general rectangular form is suitable for the purposes described herein. An optional cutout 106 may be formed into a portion of body 103 around the perimeter. This may be done to assist with the form and fit to various styled guns. It is understood that the type of material used to generate body 103 may be varied and is functional with many known materials.

Clamp assembly 105 is configured to secure body 103 to a lower surface of a gun. Clamp assembly 105 includes a clamp 105*a* and a stop 105*b*. Clamp 105*a* is seated within track 107, and track 107 is situated between upper surface 103*a* and lower surface 103*b*. Clamp 105*a* is configured to translate perpendicular to a longitudinal centerline 108 of body 103 within track 107. Movement of clamp 105*a* adjusts the distance between itself and stop 105*b*. The base 105*c* of clamp 105*a* is at least flush with upper surface 103*a*, or set at or below. It is understood that in an effort to minimize the overall profile of assembly 101, track 107 is recessed into main body 103. Clamp assembly 105 may have any portion thereof machined into main body 103.

Base 105*c* translates within track 107 between a first position and a second position. In a first position, clamp 105*a* is retreated from stop 105*b* wherein the distance between the two is greatest. In the second position, clamp 105*a* is advanced toward stop 105*b* wherein the distance between the two is the least. Both clamp 105*a* and stop 105*b* extend upward above upper surface 103*a*. Each may have a particular shape to facilitate grasping an object. As depicted, each is formed to create a dovetail clamp configuration wherein the slope of the inner lower surface is approximately 45 degrees relative to the upper surface 103*a*. However shaped, clamp 105*a* and stop 105*b* are configured to be Arca-compatible so as to capture and secure to a rail along the length of a gun.

As seen in the Figures, two clamp assemblies 105 are illustrated. One or more may be used. When a plurality are used in the gun stability plate assembly, they help to align the gun with the centerline 108 of body 103. When a singular clamp assembly 105 is used, such may be sized to have a greater overall length or width to assist in alignment of the gun.

Figure 2:
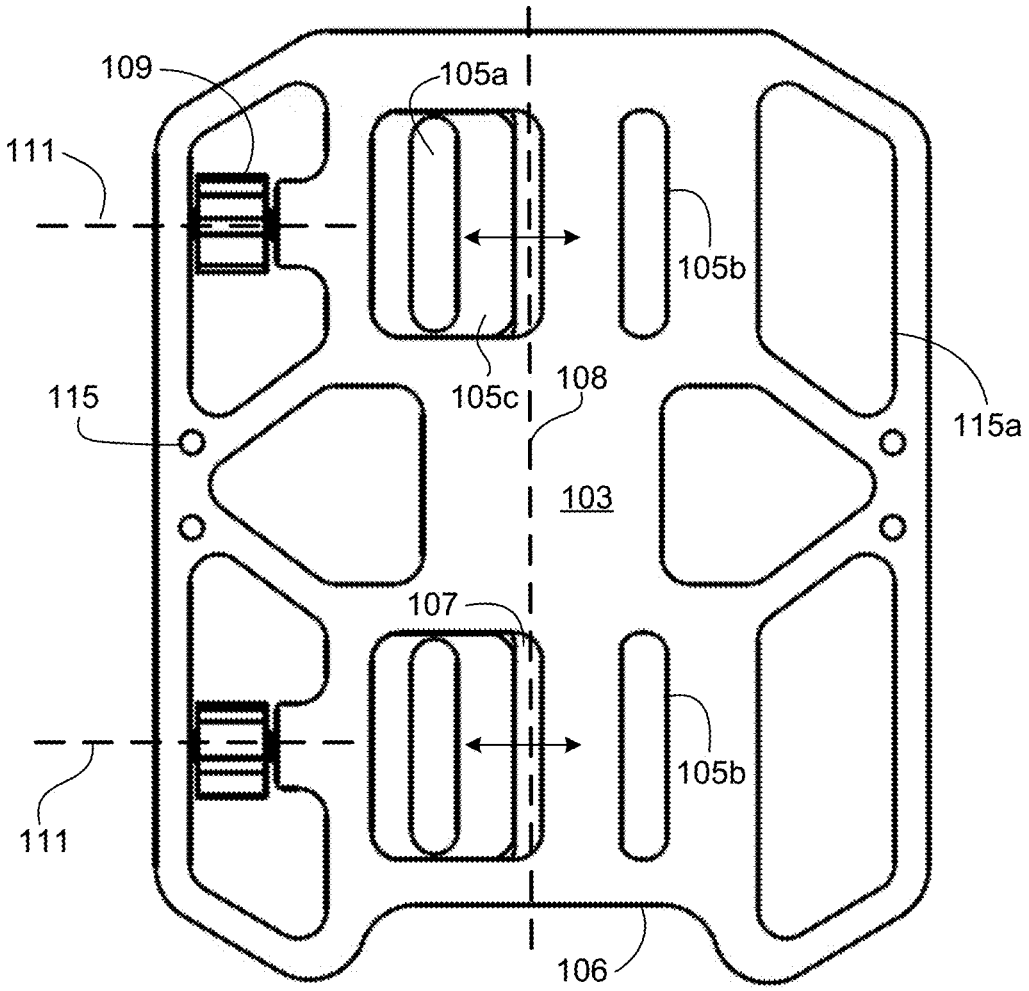
FIG. 2 is a top view of the gun plate assembly of FIG. 1.
Figure 3:
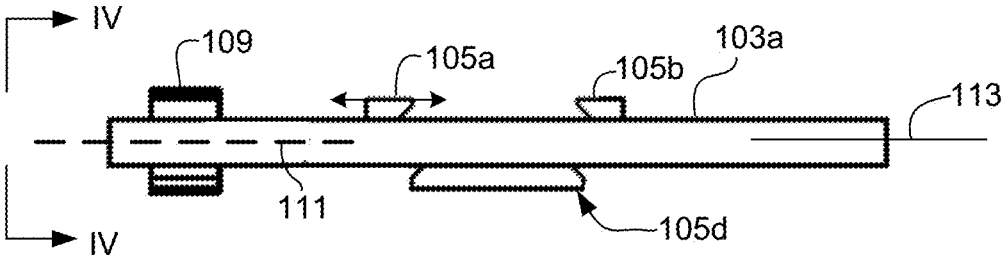
FIG. 3 is a front view of the gun plate assembly of FIG. 2.
Figure 4:
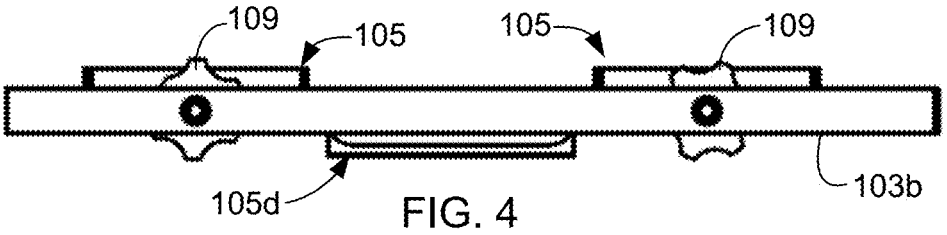
FIG. 4 is a side view of the gun plate assembly of FIG. 3.
Figure 5:
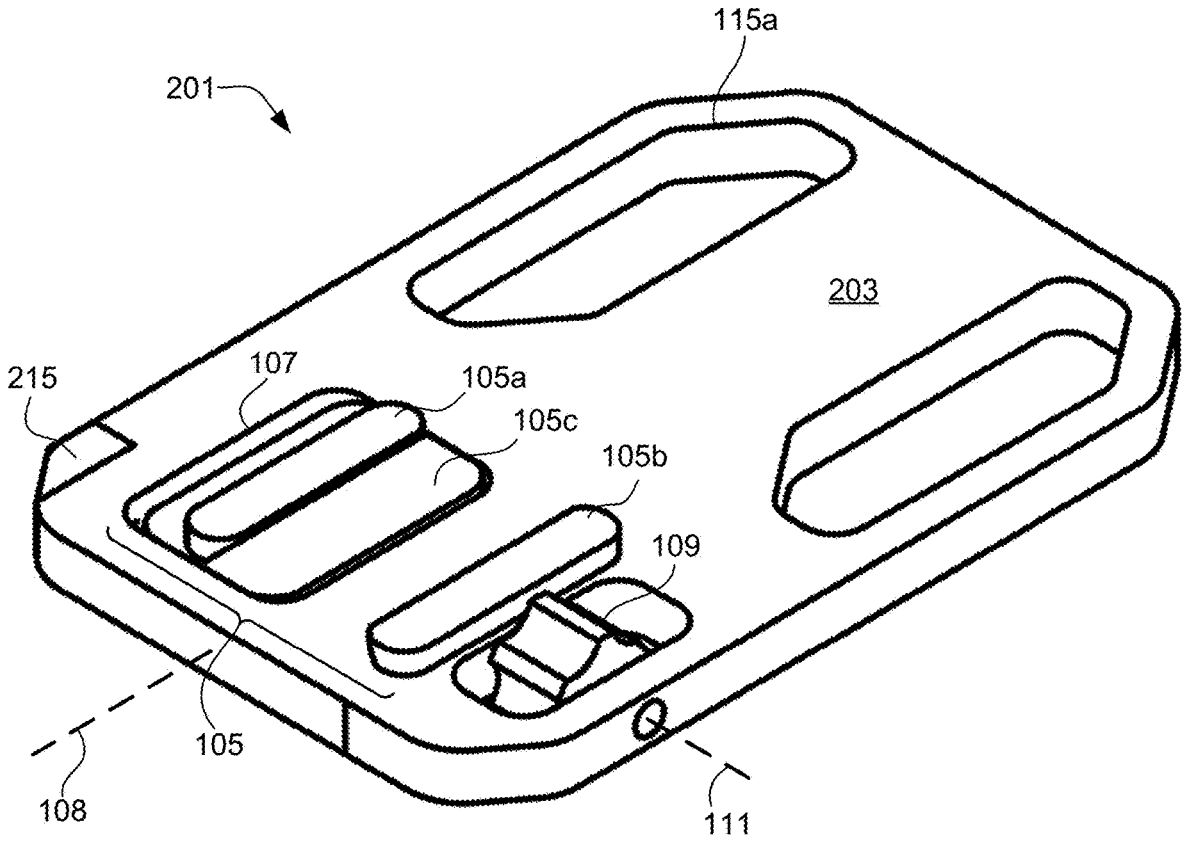
FIG. 5 is a perspective view of an alternate gun plate assembly according to an embodiment of the present application.
Figure 6:
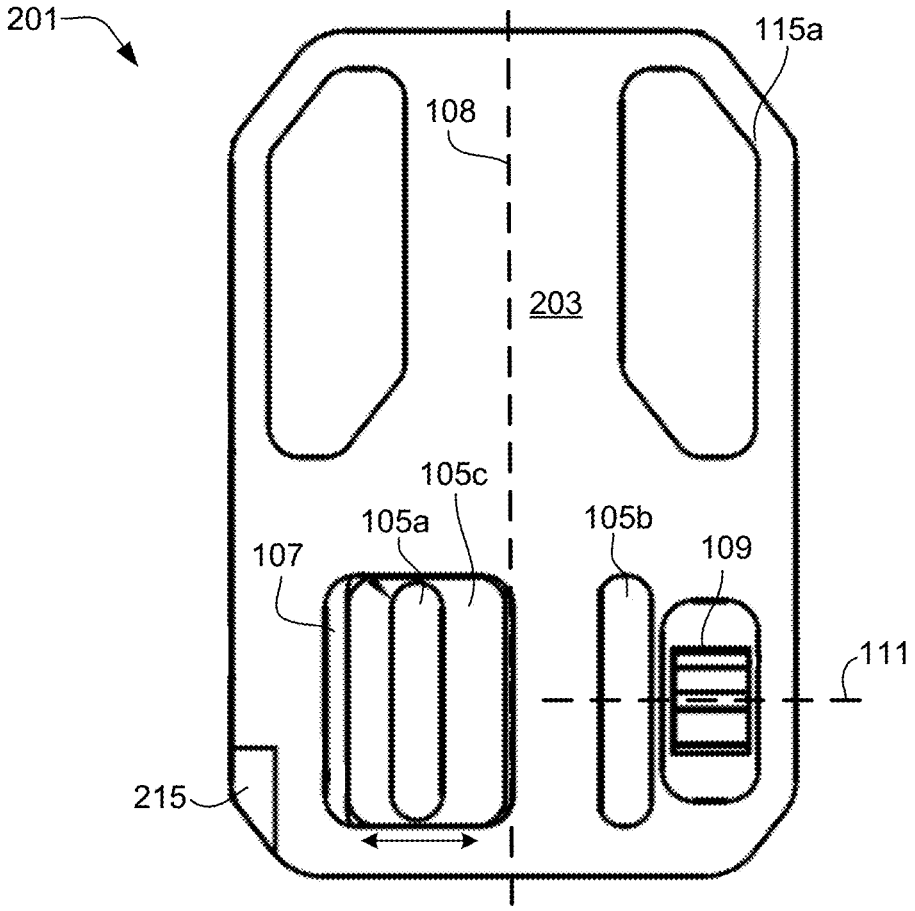
FIG. 6 is a top view of the gun plate assembly of FIG. 5.
Figure 7:
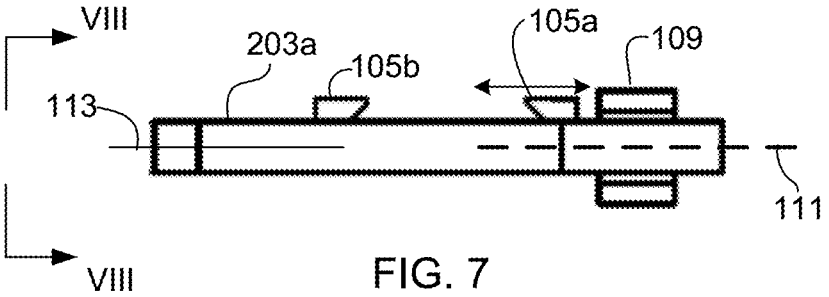
FIG. 7 is a front view of the gun plate assembly of FIG. 6.
Figure 8:
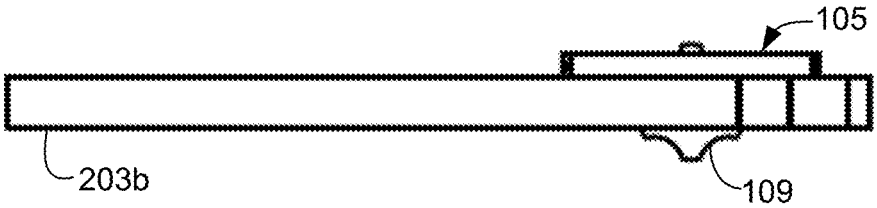
FIG. 8 is a side view of the gun plate assembly of FIG. 7.
Figure 9:
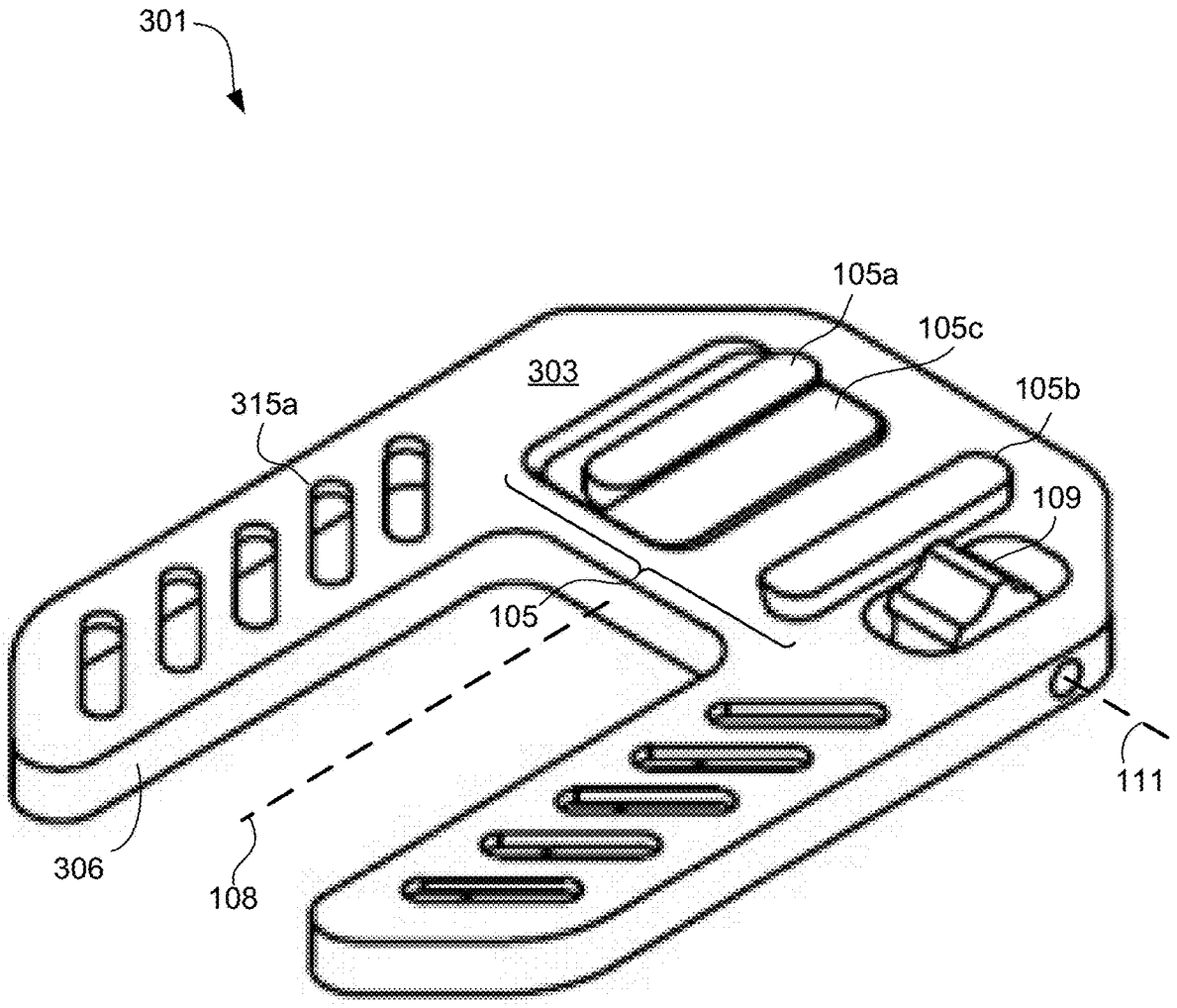
FIG. 9 is a perspective view of an alternate gun plate assembly according to an embodiment of the present application.
Figure 10:
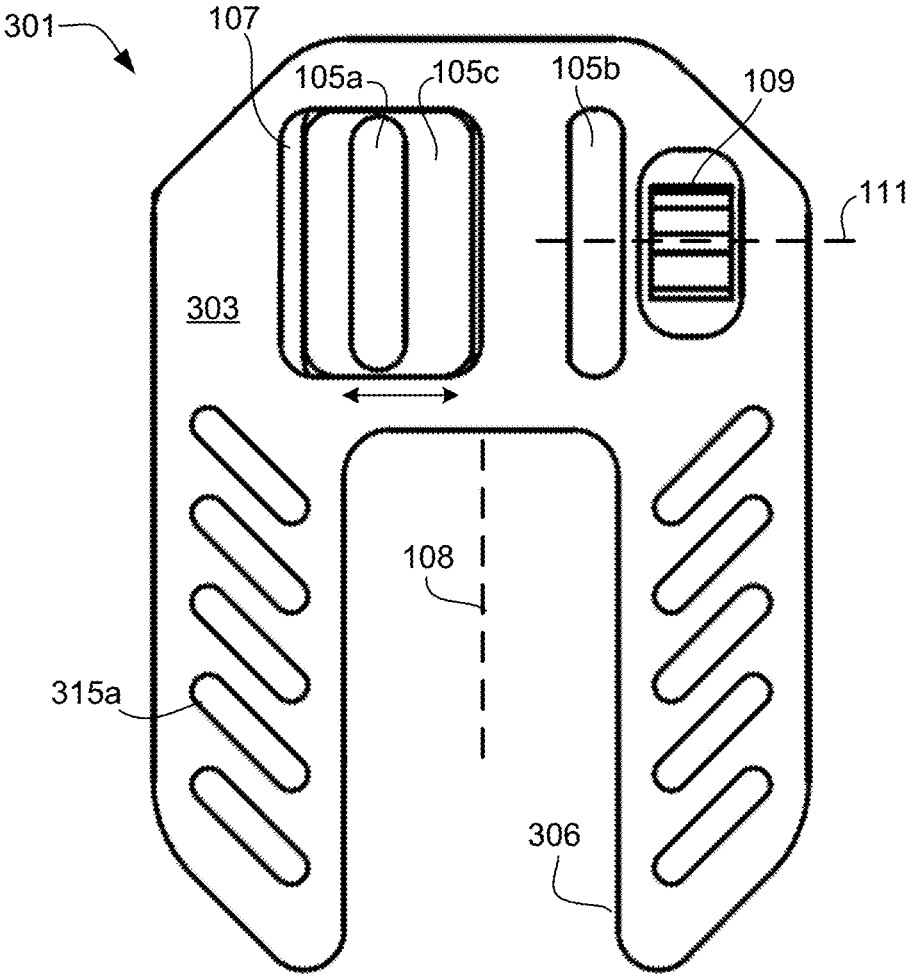
FIG. 10 is a top view of the gun plate assembly of FIG. 9.
Figure 11:
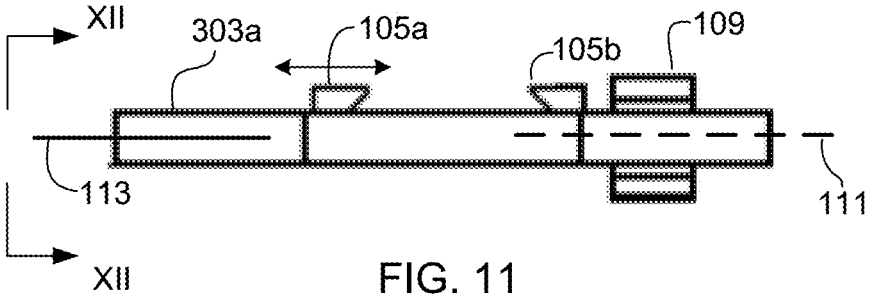
FIG. 11 is a front view of the gun plate assembly of FIG. 10.
Figure 12:
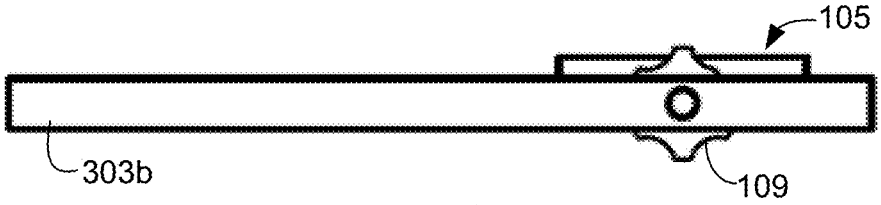
FIG. 12 is a side view of the gun plate assembly of FIG. 11.

In FIGS. 1 and 2, clamp assemblies 105 are illustrated as extending above upper surface 103*a*. In FIGS. 3 and 4 it is seen that a clamp assembly may also extend away from lower surface 103*b*. Clamp assembly 105*d* has a similar form and function to that of clamp assemblies 105 but is oriented such that it extends downward from lower surface 103*b*. This helps to facilitate the attachment of assembly 101 to a secondary stabilizing object such as a tripod or even with a gun accessory. Assembly 101 may include any either or none of clamp assemblies 105 and 105*d*.

Assembly 101 includes a knob 109 in communication with clamp assembly 105. Knob 109 is configured to regulate operation of clamp 105*a* between the first position and the second position. As knob 109 is rotated about axis 111, clamp 105*a* translates between positions. Knob 109 is just an exemplary form of a control device that may be used to facilitate movement of clamp 105*a*. They type of control device in use with assembly 101 is not herein limited to only knob 109.

As seen in the Figures, knob 109 is situated so as to be recessed with axis 111 between upper surface 103*a* and lower surface 103*b*. In this particular example, axis 111 is coplanar with or aligned with a central horizontal plane 113 (see FIG. 3) of body 103. By located the axis of rotation of knob 109 between surfaces 103*a* and 103*b*, the overall profile impact of knob 109 is minimized. Additionally, knob 109 is located within an aperture inside the perimeter of body 103. This helps to minimize the width and also accidental adjustment of knob 109. To facilitate movement of clamp 105*a*, knob 109 is associated with a threaded rod that is in communication with base 105*c*. Operation of knob 109 permits clamp assembly 105 to grasp or secure an object such as a gun adjacent upper surface 103*a*. Likewise clamp assembly 105*d* grasps and secures an object adjacent lower surface 103*b*.

Assembly 101 may further include one or more accessory apertures 115 or 115*a*. These accessory apertures are used to coupled auxiliary accessories or equipment to assembly body 103. These are situated in communication with either or both of upper surface 103*a* and/or 103*b*. Apertures 115 or 115*a* do not need to pass through body 103 but may optionally do so in some embodiments or rather elect to be sunken into body 103 only in other embodiments. Aperture 115*a* is configured to pass through body 103 and can be formed in any location along a surface. Aperture 115 is illustrated more as a fastener hole configured to accept one or more fasteners. Either form is possible. Example accessories are a scope or light.

Referring now also to FIGS. 5-8 in the drawings, views of an alternate embodiment of assembly 101 are illustrated. Gun stability plate assembly 201 is similar in form and function to that of assembly 101. Numerical numbering similar between the Figures will refer to parts having similar functions and features. Assembly 201 includes main body 203 having upper surface 203*a* and lower surface 203*b*. The physical limitations and features of body 203 are similar to that of body 103. Assembly 201 uses clamp assembly 105 and associated parts to induce a clamping effect upon a gun.

Assembly 201 differs from assembly 101 in that body 203 is shown having a singular clamp assembly 105 associated with upper surface 203*a*. No additional clamp assembly 105 is associated with lower surface 203*b*, although such is possible. Accessory aperture 215 is similar to aperture 115 except that herein it is a notch formed about the perimeter of body 203. The operation of clamp assemblies 105 and the associated parts are similar between the embodiments.

Referring now also to FIGS. 9-12 in the drawings, views of an alternate embodiment of assembly 101 are illustrated. Gun stability plate assembly 301 is similar in form and function to that of assembly 101 and 201. Numerical numbering similar between the Figures will refer to parts having similar functions and features. Assembly 301 includes main body 303 having upper surface 303*a* and lower surface 303*b*. The physical limitations and features of body 303 are similar to that of body 103 and 203. Assembly 301 uses clamp assembly 105 and associated parts to induce a clamping effect upon a gun.

Assembly 301 differs from assembly 101 in that body 303 is shown having a singular clamp assembly 105 associated with upper surface 303a. No additional clamp assembly 105 is associated with lower surface 203*b*, although such is possible. Cutout 306 is formed in the perimeter of body 303. Such cutout 306 is more exaggerated or pronounced than cutout 106, extending a good portion of the length of body 303 adjacent to clamp assembly 105. This illustrates another example of changes in the main body throughout the different embodiments. Accessory aperture 315*a* is similar to aperture 115*a* except that the location is different.

Figure 13:
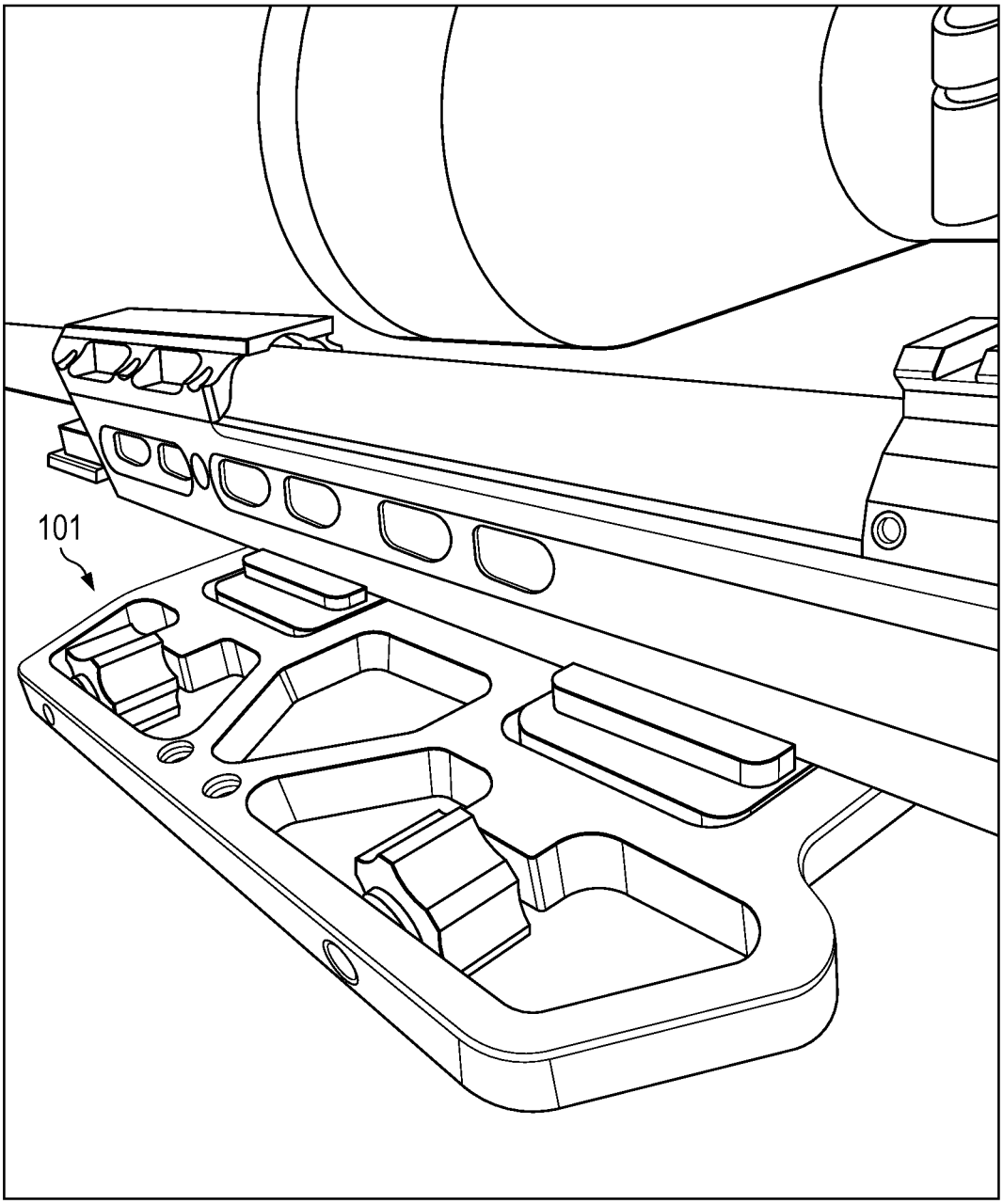
FIG. 13 is a perspective view of the gun plate assembly of FIG. 1 mounted with a firearm.

Referring now also to FIG. 13 in the drawings, an exemplary perspective view of assembly 101 secured to a gun is shown. As seen, body 103 creates a widened footprint to increase the stability of the gun. Additional sandbags are not necessary. Assemblies 101, 201, 301 are light weight and easier to transport than sandbags. Additionally, clamp assemblies 105 provide increased precision in orientation when compared to squishing the gun in a sandbag.

The current application has many advantages over the prior art. The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A gun stability plate assembly, comprising:

a main body having an upper surface and a lower surface while defining a perimeter therebetween;

a clamp assembly in communication with the main body, the clamp assembly having a clamp configured to translate adjacent the upper surface of the main body, the clamp assembly includes a stop affixed onto the main body opposite the clamp, the clamp configured to translate between a first position and a second position relative to the stop;

a rotating knob configured to regulate operation of the clamp, the rotating knob located within the perimeter of the main body; and a track formed into the main body and configured to seat the clamp.

2. The assembly of claim 1, wherein the clamp is recessed into the main body such that the clamp is flush with the upper surface of the main body.

3. The assembly of claim 1, wherein the clamp is a dovetail clamp.

4. The assembly of claim 1, wherein the clamp is Arca-compatible.

5. The assembly of claim 1, wherein the clamp extends above the upper surface of the main body, the clamp grasping an object adjacent the upper surface.

6. The assembly of claim 5, wherein the clamp extends below the lower surface of the main body, the clamp grasping an object adjacent the lower surface.

7. The assembly of claim 1, wherein the clamp extends below the lower surface of the main body, the clamp grasping an object adjacent the lower surface.

8. The assembly of claim 1, wherein an axis of the knob is aligned with a central plane of the main body.

9. The assembly of claim 1, wherein the track is recessed into the main body.

10. The assembly of claim 1, further comprising:

an accessory aperture located within the main body and configured to permit attachment of one or more accessories.

11. The assembly of claim 1, wherein the main body includes a cutout extending inward from the perimeter of the main body.

12. A gun stability plate assembly, comprising:

a main body having an upper surface and a lower surface while defining a perimeter therebetween;

a clamp assembly in communication with the main body, the clamp assembly having a clamp configured to translate adjacent the upper surface of the main body, the clamp assembly includes a stop affixed onto the main body opposite the clamp, the clamp configured to translate between a first position and a second position relative to the stop;

a rotating knob configured to regulate operation of the clamp, an axis of the knob is coplanar with a central plane of the main body, the rotating knob located within the perimeter of the main body;

a track formed into the main body and configured to seat the clamp, the track is recessed into the main body; and an accessory aperture located within the main body and configured to permit attachment of one or more accessories.

13. The assembly of claim 12, wherein the clamp is recessed into the main body such that the clamp is flush with the upper surface of the main body.

14. The assembly of claim 12, wherein the clamp is a dovetail clamp.

15. The assembly of claim 12, wherein the clamp is Arca-compatible.

16. The assembly of claim 12, wherein the clamp extends above the upper surface of the main body, the clamp grasping an object adjacent the upper surface.

17. The assembly of claim 12, wherein the clamp extends below the lower surface of the main body, the clamp grasping an object adjacent the lower surface.

18. The assembly of claim 12, wherein the main body includes a cutout extending inward from the perimeter of the main body.

* * * * *